US007029234B2

(12) United States Patent
Jensen

(10) Patent No.: US 7,029,234 B2
(45) Date of Patent: Apr. 18, 2006

(54) AIR OUTLET UNIT FOR A LARGE BLOWER ASSEMBLY

(75) Inventor: Erling Jensen, Næstved (DK)

(73) Assignee: Howden Power A/S, Naestved (DK)

( * ) Notice: Subject to any disclaimer, the term of this patent is extended or adjusted under 35 U.S.C. 154(b) by 0 days.

(21) Appl. No.: 10/479,599

(22) PCT Filed: Jun. 6, 2001

(86) PCT No.: PCT/DK01/00385

§ 371 (c)(1),
(2), (4) Date: Jul. 13, 2004

(87) PCT Pub. No.: WO02/099288

PCT Pub. Date: Dec. 12, 2002

(65) Prior Publication Data

US 2004/0240993 A1 Dec. 2, 2004

(51) Int. Cl.
*F01D 9/00* (2006.01)

(52) U.S. Cl. ..... 415/207; 415/220

(58) Field of Classification Search ..... 415/207, 415/211.2, 220, 223
See application file for complete search history.

(56) References Cited

U.S. PATENT DOCUMENTS 2,552,118 A 5/1951 Sawyer
2,637,487 A 5/1953 Sawyer
2,814,433 A 11/1957 Brinen
3,471,080 A 10/1969 Gray
3,566,606 A * 3/1971 Mortlock ..... 60/226.1
3,860,359 A * 1/1975 De Feo ..... 415/208.2
3,927,521 A * 12/1975 Hugoson et al. ..... 60/796

FOREIGN PATENT DOCUMENTS

WO WO 0198668 A1 12/2001

* cited by examiner

*Primary Examiner*—Edward K. Look
*Assistant Examiner*—Devin Hanan
(74) *Attorney, Agent, or Firm*—Sughrue Mion, PLLC

(57) ABSTRACT

An air outlet unit (101) for a large blower assembly comprising an outlet tube member (103) with an upstream inner end in flow communication with the pressure side of an impeller of the blower asembly and a downstream outer end for connection with a duct and a mainly cylindrical inner tube member (105) arranged coaxially to the outlet tube member (103) and having an inner end substantially aligned with the inner end of the outlet tube member (103) and a downstream outer end, the inner tube member (105) being closed by a closing means (106). The inner tube member (105) has an open downstream end (8114) projecting in the downstream direction beyoud the downstream outer end of the outlet tube member (103) to thereby achieve a reduced pressure loss and a more uniform velocity profile.

19 Claims, 4 Drawing Sheets

AIR OUTLET UNIT FOR A LARGE BLOWER ASSEMBLY

Figure 1:
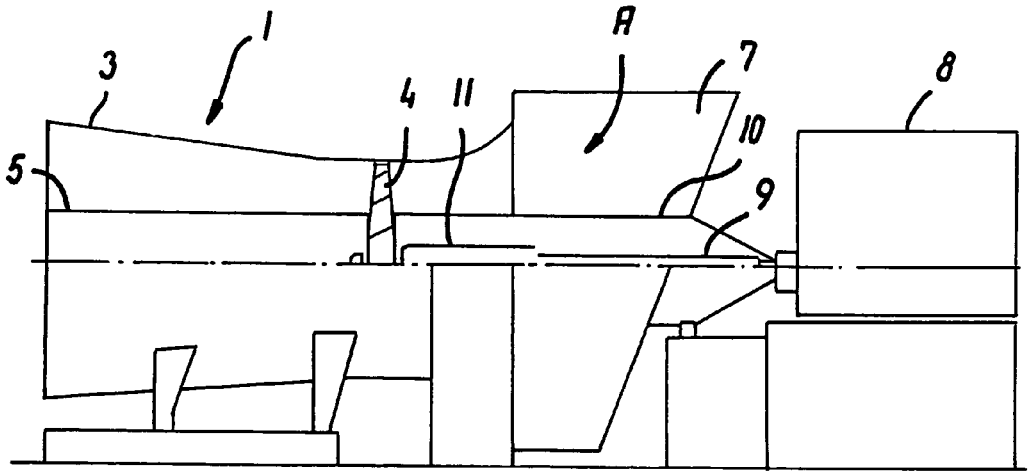
PRIOR ART FIG.1

The present invention relates to an air outlet unit for a large blower assembly comprising an outlet tube member with an upstream inner end in flow communication with the pressure side of an impeller of the blower assembly and a downstream outer end for connection with a duct and a mainly cylindrical inner tube member arranged coaxially to the outlet tube member and having an inner end substantially aligned with the inner end of the outlet tube member and a downstream outer end, the inner tube member being closed by a closing means.

In large blower assemblies for power stations, fluidized bed systems, tunnels and the like, the power of the motor to drive the impeller may be 700 kW or even more, so the efficiency of the blower assembly is of critical importance. The development of larger blower assemblies has furthermore tightened the requirements for the different parts as the velocity and pressure of the fluid increases.

This is the case with all air outlet units of the above mentioned type handling gases at high velocity and pressure where eddies and recirculating flow at the end of the inner tube member will have a serious adverse effect on the efficiency.

An object of the present invention is to provide an air outlet unit with improved efficiency, i.e. reduced pressure loss and a more uniform velocity profile.

The air outlet unit according to the invention is characterized in that the inner tube member has an open downstream end projecting in the downstream direction beyond the downstream outer end of the outlet tube member.

The impact of the open downstream end is that the recirculating flow and/or eddies are more or less contained in the open end of the inner tube so that they only to a limited extent disturb the flow, and maybe even have a positive influence on the flow. Further is obtained an improvement of the flow, so the velocity profile is smoothed out to an ideal profile in a shorter distance after the air outlet in comparison with the known construction.

According to a preferred embodiment, the air outlet unit is characterized in that the length of the projecting downstream end of the inner tube member from the downstream outer end of the outlet tube member to the downstream end of said projecting end is in the range from 0.25·D to 1.5·D, preferably about 1·D, where D is the diameter of the inner tube member. In studies of the impact of different lengths of the projection it was found that with these lengths of the projection excellent results were obtained, presumably because the flow has not stabilized until a certain distance after exit of the air outlet unit.

According to a further embodiment, the air outlet unit is characterized in that the inner tube member comprises a base section and an extension tube element. This means that an ordinary air outlet unit of the prior art can be retrofitted with an open ended extension tube element in the downstream end of the original inner tube member. In this way, the efficiency of an air outlet can be improved in a very easy way and at a favourable expense.

According to another embodiment, the air outlet unit is characterized in that the closing means of the inner tube member is placed somewhere between the inner end of the inner tube and a position in alignment with the downstream outer end of the outlet tube member. The function of the closing means is to close off the inner tube so no return flow will go through the inner tube. This closing means may be positioned anywhere between the inner end of the inner tube and a position in alignment with the downstream end of the outlet tube.

A special type of air outlet unit is a diffuser, the objective of which is to expand the flow of air or exhaust gasses from one area of flow, corresponding to the size of the blower, to a larger cross section area corresponding to the succeeding channel. As the area of flow expands the flow is retarded and pressure increases. This means that the fluid is flowing against an adverse pressure gradient, and as a consequence there is an even higher risk of separation and/or recirculation of the flow in or after the diffuser than in other air outlet units, and this will have a strong negative influence on the efficiency of the blower assembly. In known diffusers recirculating flow and eddies are generated at the end of the inner tube, and this has a detrimental effect on the fluid flow. The recirculating flow and the eddies cause a flow change (change of velocity profile), which will not be smoothed out till a long distance after the diffuser, and which in the worst case result in an unwanted loss because of shock waves in the fluid.

According to a preferred embodiment the air outlet unit is a diffuser with an outlet tube member having slightly diverging walls in the downstream direction. The advantages of the invention will be even greater in diffusers than in other air outlet units, as the fluid is flowing against an adverse pressure gradient.

In another embodiment, the air outlet unit is a nozzle with an outlet tube member having slightly converging walls in the downstream direction.

Figure 2:
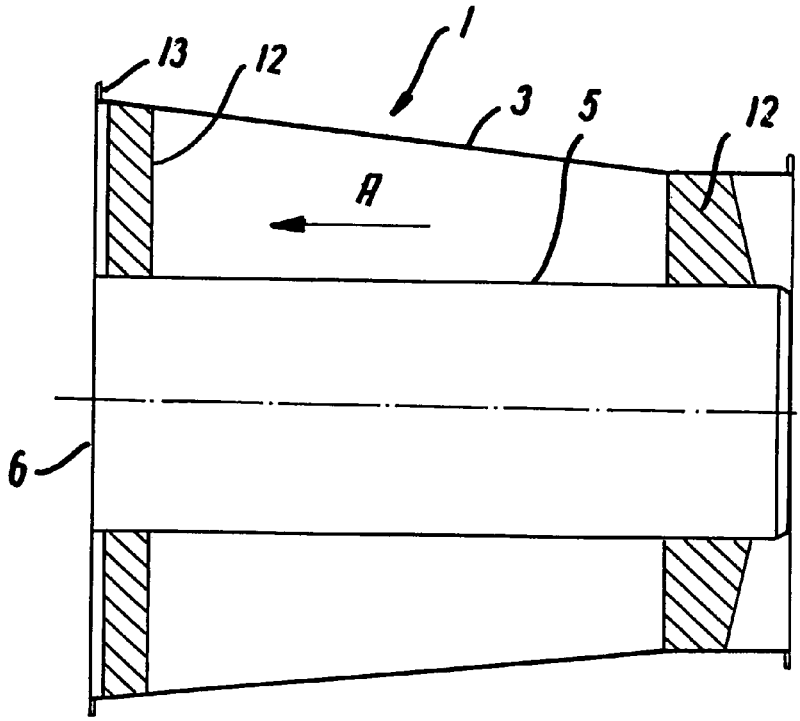
PRIOR ART FIG.2
Figure 3:
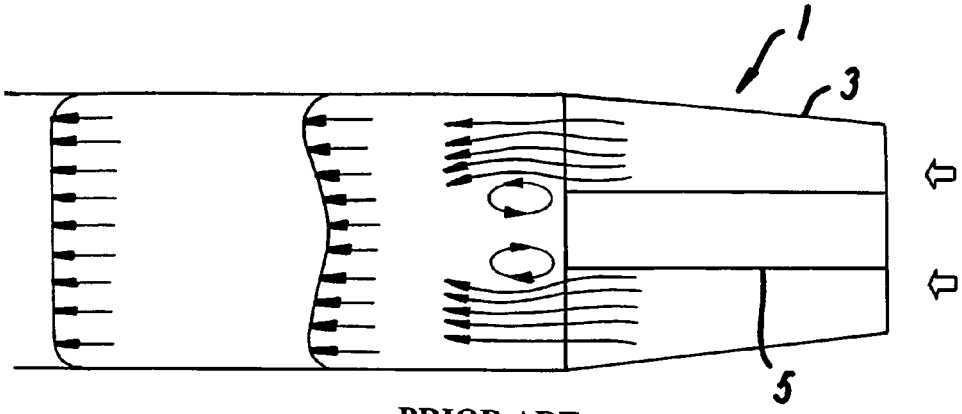
PRIOR ART FIG. 3
Figure 4:
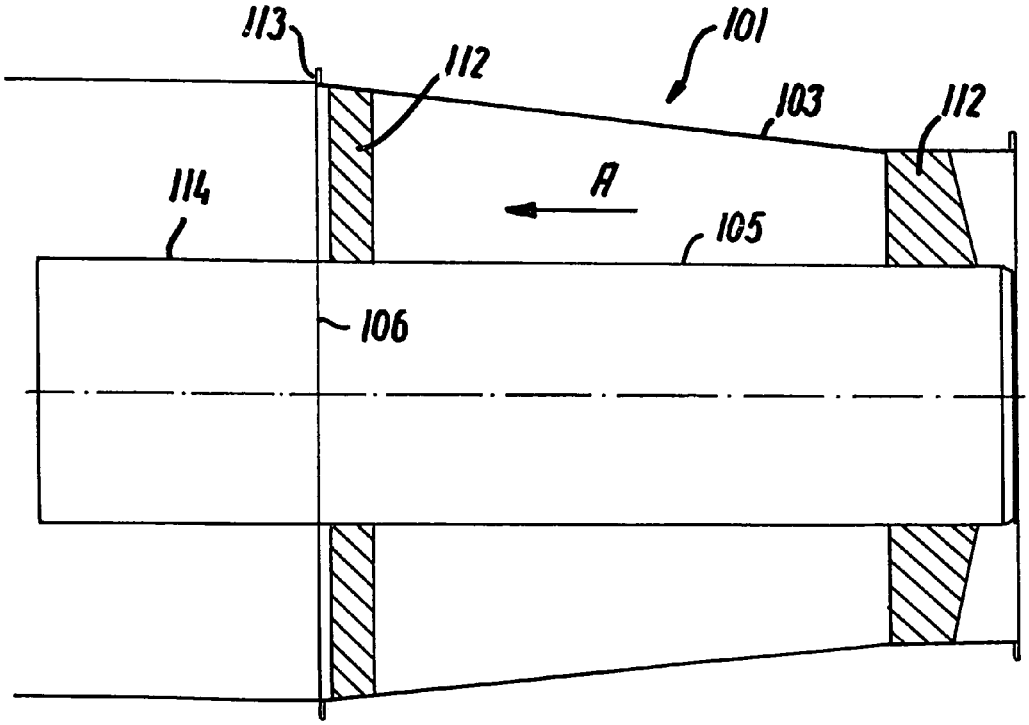
Figure 5:
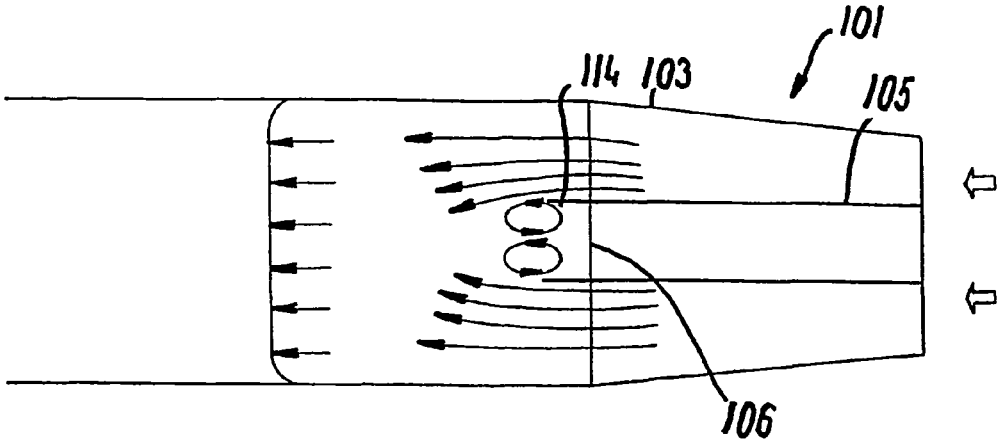
Figure 6:
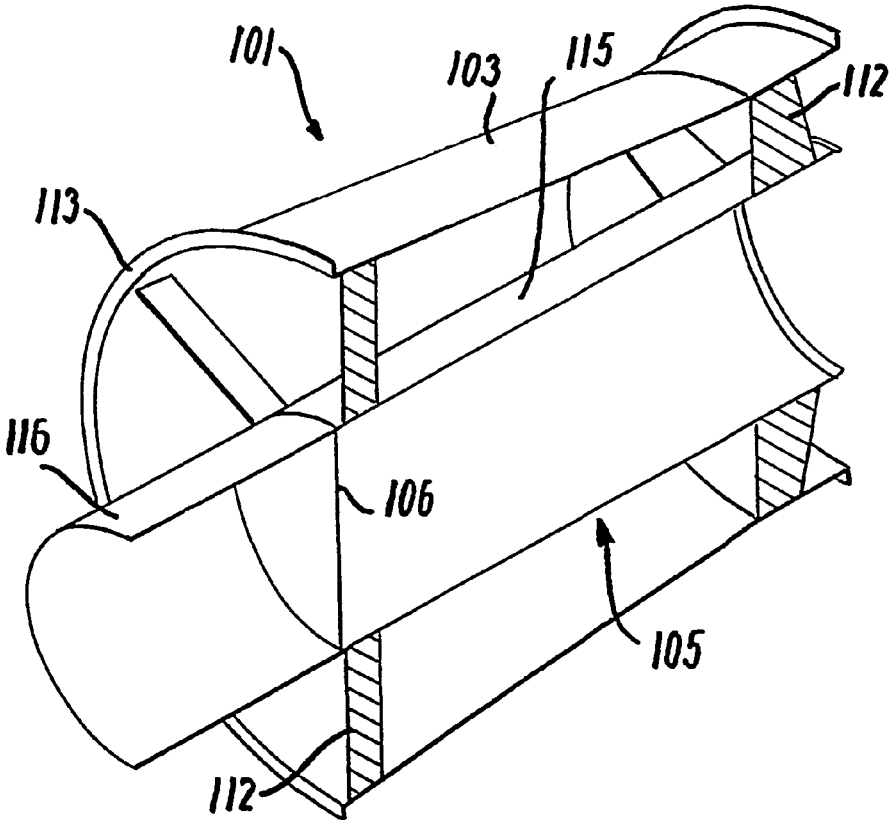

The invention will in the following be descriped in detail with reference to the associate drawing, where FIG. 1 is an end view of a large blower assembly in partial cross section, FIG. 2 is a cross section of a prior art diffuser, FIG. 3 shows a schematic view of the flow and a velocity profile after the diffuser according to FIG. 2, FIG. 4 is a cross section of a diffuser according to the invention, FIG. 5 shows a schematic view of the flow and a the velocity profile after the diffuser according to FIG. 4, and FIG. 6 is a perspective cross sectional view of the diffuser according to FIG. 4.

Figure 7:
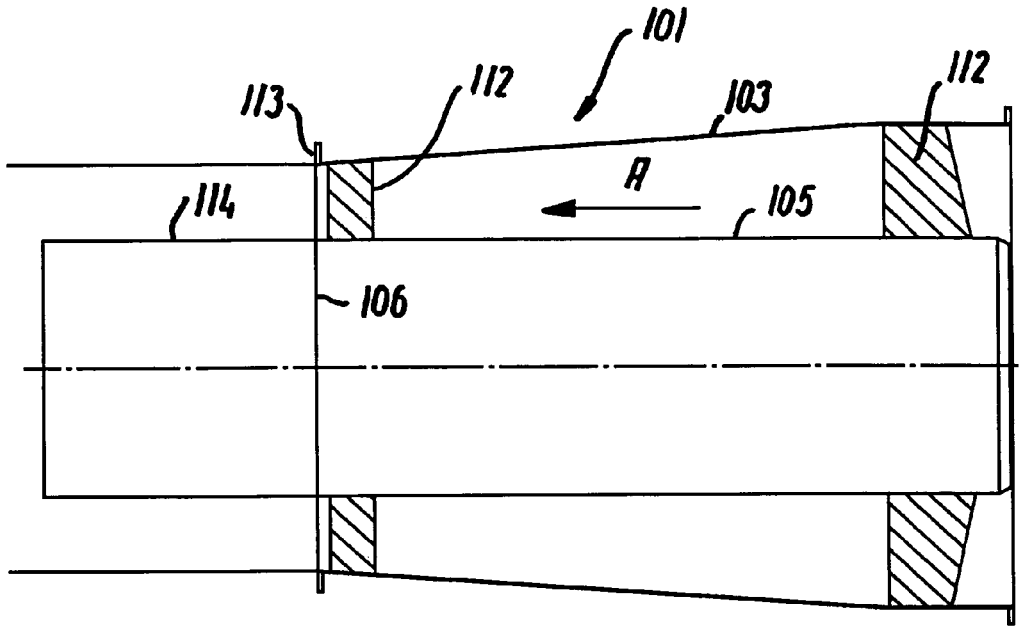

FIG. 7 is a view corresponding to that of FIG. 4, of another embodiment of the diffuser.

Referring to FIG. 1, the blower assembly 2 includes a suction box 7 with an inlet for air, an impeller 4 and a diffuser 1. The impeller 4 is driven by a motor 8 connected to the impeller 4 by a shaft 9 extending through the suction box 7. A tubular body 10 through the suction box 7 contains the shaft 9, main bearings 11 and any other equipment. A fluid e.g. air to a power station or smoke gas exhaust from a power station is drawn in by the impeller 4 into the suction box 7 in the direction shown by the arrow A, and the suction box 7 imparts a change of flow direction from the inlet to the impeller 4. The impeller 4 with blades is rotated by the shaft 9 connected to the motor 8, while the blades in turn provides an increase in pressure in the fluid. As mentioned the shaft 9 passes through the suction box 7 in the tubular body 10, which may also hold main bearings 11 for the shaft 9, conduits for sealing air, and equipment necessary or useful for the function, monitoring or control of the blower. This means that the dimensions of the tubular body 10 is usually rather large, e.g. for a impeller 4 with a diameter at the blade tip of 3200 mm, the diameter of the tubular body 10 may be 1600 mm.

The prior art diffuser shown in FIG. 2 has a mainly cylindrical inner tube member 5 and diverging outer walls, to which the inner tube member 5 is connected by a series of spacers 12 at each end of the diffuser 1. The diffuser 1 will normally be connected to a duct at a flange 13 arranged at its downstream end, and at the interface between the diffuser 1 and the duct, the fluid flow experiences a sudden area increase. At its downstream end the inner tube member 5 is closed by a closing means 6 in the form of a wall, positioned approximately in alignment with the connecting flange 13. As can be seen in FIG. 3, the fluid flow separates at the downstream end of the inner tube member 5 and a recirculating flow arises immediately downstream of the tube end. This recirculating flow causes a change of effective geometry, as the recirculating flow pushes the main flow radially outward, and furthermore the recirculating flow reduces the velocity of the main flow at the interface between the main flow and recirculating flow.

With reference to FIG. 41 the diffuser 101 according to the invention is fitted with an inner tube member 105 projecting out of the outlet tube member 103 beyond the connection flange 113 at which the diffuser 101 is connected with a duct, not shown. The length of the projecting downstream end beyond the outer end of the outlet tube member 103 can be chosen in relation to the flow velocity, the fluid and dimensions of the diffuser 101, but will normally be in the range from 0.25·D to 1.5·D, preferably about 1·D, where D is the diameter of the inner tube member 105.

By this measure the efficiency of the diffuser 101 is improved, and a sketch of the improved velocity profile at the outlet of the diffuser 101 according to the invention can be seen in FIG. 5. As can be seen, the recirculating flow is partly contained in the hollow end of the inner tube member 105, so the influence of the recirculating flow on the main flow is greatly reduced.

A favourable way of acheiving an inner tube member with these characteristics is to fit a known inner tube member with an extension tube element 116 in the downstream end.

FIG. 6 is perhaps a more illustrative view of the diffuser 1 according to the invention. As can be seen, the inner tube member 105 consists of two parts, a base element 115 and an extension tube element 116, so the closing means 106 is set back relative to the end of the extension tube element 116, while the extension tube member 116 in turn projects out of the outlet tube member 103. Again the inner tube member 115 is connected to the outlet tube member 103 by spacers 112, and a duct can be connected to the diffuser 101 at flange 113.

FIG. 7 shows another embodiment, whereby the air outlet unit is a nozzle with an outlet tube member 103 having slightly converging walls in the downstream direction.

The closing means 106 of the inner tube member may be placed anywhere along the length of the inner tube, as long as the inner tube is open ended. However it is preferred that the closing means is placed near a position in alignment with the downstream outer end of the outlet tube member or upstream of this.

The closing means 106 of the inner tube member may take any appropriate form, e.g. a wall, a block, a partition, a plate etc.

The extension tube element 116 is preferably cylindrical, but may be slightly conical.

The use of a diffuser to illustrate the invention in the drawing should not be limiting, as the invention will also improve efficiency of other air outlet units, such as air outlets having an outlet tube with cylindrical, non-diverging walls.

The invention claimed is:

1. An air outlet unit (1, 101) for a large blower assembly (2) comprising an outlet tube member (3, 103) with an upstream inner end in flow communication with the pressure side of an impeller (4) of the blower assembly (2) and a downstream outer end for connection with a duct and a mainly cylindrical inner tube member (5, 105, 115) arranged coaxially to the outlet tube member (3, 103) and having an inner end substantially aligned with the inner end of the outlet tube member (3, 103) and a downstream outer end, the inner tube member (5, 105, 115) being closed by a closing means (6 106), characterized in that the inner tube member (5, 105, 115) has an open downstream end (114, 116) projecting in the downstream direction beyond the downstream outer end of the outlet tube member (3, 103).

2. An air outlet unit according to claim 1, characterized in that the length of the projecting downstream end (114, 116) of the inner tube member (5, 105, 115) from the downstream outer end of the outlet tube member (3, 103) to the downstream end of said projecting end (114, 116) is in the range from 0.25·D to 1.5·D, where D is the diameter of the inner tube member (5, 105).

3. An air outlet unit according to claim 2, characterized in that the inner tube member (5, 105) comprises a base section (115) and an extension tube element (116).

4. An air outlet unit according to claim 3, characterized in that the closing means (6, 106) of the inner tube member (5, 105, 115) is placed between the inner end of the inner tube (5, 105, 115) and a position aligned with the downstream outer end of the outlet tube member (3, 103).

5. An air outlet unit according to claim 4, characterized in that the unit is a diffuser with an outlet tube member (3, 103) having slightly diverging walls in the downstream direction.

6. An air outlet unit according to claim 2, characterized in that the closing means (6, 106) of the inner tube member (5, 105, 115) is placed between the inner end of the inner tube (5, 105, 115) and a position aligned with the downstream outer end of the outlet tube member (3, 103).

7. An air outlet unit according to claim 2, characterized in that the unit is a diffuser with an outlet tube member (3, 103) having slightly diverging walls in the downstream direction.

8. An air outlet unit according to claim 2, characterized in that the air outlet unit is a nozzle with an outlet tube member (3, 103) having slightly converging walls in the downstream direction.

9. An air outlet unit according to claim 1, characterized in that the inner tube member (5, 105) comprises a base section (115) and an extension tube element (116).

10. An air outlet unit according to claim 9, characterized in that the closing means (6, 106) of the inner tube member (5, 105, 115) is placed between the inner end of the inner tube (5, 105, 115) and a position aligned with the downstream outer end of the outlet tube member (3, 103).

11. An air outlet unit according to claim 10, characterized in that the air outlet unit is a nozzle with an outlet tube member (3, 103) having slightly converging walls in the downstream direction.

12. An air outlet unit according to claim 9, characterized in that the unit is a diffuser with an outlet tube member (3, 103) having slightly diverging walls in the downstream direction.

13. An air outlet unit according to claim 9, characterized in that the air outlet unit is a nozzle with an outlet tube member (3, 103) having slightly converging walls in the downstream direction.

14. An air outlet unit according to claim 1, characterized in that the closing means (6, 106) of the inner tube member (5, 105, 115) is placed between the inner end of the inner tube (5, 105, 115) and a position aligned with the downstream outer end of the outlet tube member (3, 103).

15. An air outlet unit according to claim 14, characterized in that the unit is a diffuser with an outlet tube member (3, 103) having slightly diverging walls in the downstream direction.

16. An air outlet unit according to claim 14, characterized in that the air outlet unit is a nozzle with an outlet tube member (3, 103) having slightly converging walls in the downstream direction.

17. An air outlet unit according to claim 1, characterized in that the unit is a diffuser with an outlet tube member (3, 103) having slightly diverging walls in the downstream direction.

18. An air outlet unit according to claim 1, characterized in that the air outlet unit is a nozzle with an outlet tube member (3, 103) having slightly converging walls in the downstream direction.

19. An air outlet unit according to claim 1, wherein the length of the projecting downstream end of the inner tube member from the downstream outer end of the outlet tube member to the downstream end of said projecting end is preferably about 1·D, where D is the diameter of the inner tube member.

* * * * *